US010571210B2

(12) United States Patent
Amodio et al.

(10) Patent No.: US 10,571,210 B2
(45) Date of Patent: Feb. 25, 2020

(54) TRIGGER GUARD FOR A FIREARM COMPRISING A PROJECTION

(71) Applicants: Chad Amodio, Fort Mill, SC (US); Ronald Andrew Bowers, Bridgeport, WV (US)

(72) Inventors: Chad Amodio, Fort Mill, SC (US); Ronald Andrew Bowers, Bridgeport, WV (US)

( * ) Notice: Subject to any disclaimer, the term of this patent is extended or adjusted under 35 U.S.C. 154(b) by 0 days.

(21) Appl. No.: 16/223,443

(22) Filed: Dec. 18, 2018

(65) Prior Publication Data

US 2019/0162498 A1 May 30, 2019

Related U.S. Application Data

(63) Continuation of application No. 15/826,581, filed on Nov. 29, 2017, now abandoned.

(51) Int. Cl.
*F41A 19/11* (2006.01)
*F41A 9/65* (2006.01)

(52) U.S. Cl.
CPC ..... *F41A 19/11* (2013.01); *F41A 9/65* (2013.01)

(58) Field of Classification Search
CPC ..... F41A 19/11; F41A 17/38; F41A 35/06
See application file for complete search history.

(56) References Cited

U.S. PATENT DOCUMENTS

| | | | | |
|---|---|---|---|---|
| 2,912,781 | A * | 11/1959 | Lizza | F41A 11/00 42/75.03 |
| 8,959,818 | B2 * | 2/2015 | Mayerl | F41A 9/55 42/6 |
| 9,217,618 | B1 * | 12/2015 | Miller, III | F41A 19/11 |
| 9,513,077 | B2 * | 12/2016 | Noro | F41A 17/38 |
| 9,683,796 | B2 * | 6/2017 | Addis | F41A 9/64 |
| 9,897,402 | B2 * | 2/2018 | Pettit | F41A 3/66 |
| 10,101,102 | B2 * | 10/2018 | Eitan | F41A 11/02 |
| 2005/0183317 | A1 * | 8/2005 | Finn | F41A 19/11 42/72 |
| 2011/0173859 | A1 * | 7/2011 | Findlay | F41A 19/11 42/69.01 |
| 2017/0219310 | A1 * | 8/2017 | Jones | F41A 11/02 |

OTHER PUBLICATIONS

"Spring Plungers & Ball Plungers", Monroe Engineering, http://catalog.monroeengineering.com/category/plungers (Year: 2016).*

* cited by examiner

*Primary Examiner* — Joshua T Semick

(57) ABSTRACT

A trigger guard for a firearm with a projection extending towards a magazine well of the firearm such that the projection extends into the magazine well. The trigger guard allows the projection to apply pressure to an inserted magazine or to limit the amount of movement of an inserted magazine within the magazine well.

19 Claims, 7 Drawing Sheets

TRIGGER GUARD FOR A FIREARM COMPRISING A PROJECTION

CROSS-REFERENCE TO RELATED APPLICATION

"Not Applicable"

BACKGROUND OF THE INVENTION

The present invention relates to a trigger guard for a firearm. The trigger guard comprising a protrusion outward towards a loadable magazine for the firearm. In particular, the present invention relates to a trigger guard for use in firearms which use a detachable magazine.

A trigger guard is used to prevent a firearm being inadvertently discharged. Trigger guards create a surrounding loop around the trigger for a firearm so to prevent accidental firing and protect from damaging the trigger itself. Trigger guards are known to be made of various metals, plastics, rubbers, and any other suitable materials. Trigger guards can be manufactured as a part of the housing assembly of a firearm or created as a removable part of a firearm that can be desirable to attach, detach and/or replace.

Considering some rifle firearms such as an M-16 style rifle or an AR-15 rifle, having trigger guards which are removeable or partially removeable by use of roll pins and/or spring pins at the rear and front of the trigger guard body. For similar items of reference, see U.S. Pat. No. 9,194,653, filed Dec. 13, 2014, entitled "Trigger Guard Tool"; U.S. Publication 2011/0173859, filed Nov. 8, 2010, entitled "Removable Trigger Guard" and U.S. Pat. No. 9,217,618, filed May 22, 2015, entitled "Tool-Less Trigger Guard".

When considering a rifle firearm using a magazine such as those style firearms mentioned above, ease of use and quick reloading have always been considered within the design of the firearm and the various magazines which can be used by a firearm. For instance, several magazines have been developed with followers or anti-tilt followers to help address issues regarding cartridge and feeding failures. However, the general use of these firearms often results in malfunctions due to tilt of the magazine and/or movement of the magazine within the magazine well. The firearms and magazine were developed in such a way to allow for readily available with easy and quick reloads, some only including a single attachment or locking position inside the well. Whether due to carrying the firearm or firing of the firearm, the magazine has a substantial amount of movement within the well which leads to malfunctions during the use of the firearm.

The object of the present invention is to provide a trigger guard which addresses the abovementioned problems regarding malfunctioning firearms.

BRIEF SUMMARY OF THE INVENTION

The present invention discloses a trigger guard for a firearm that comprises a projection which extends towards a magazine to be used in the firearm, wherein the projection is positioned to make physical contact with the magazine.

The present invention discloses a trigger guard for a firearm that comprises a projection which extends toward a magazine to be used in the firearm, wherein the projection is positioned to such as to limit a certain amount of movement of the magazine within the magazine well of the firearm.

These and other features, benefits and aspects of the present invention are described with reference to the drawings and following specification.

BRIEF DESCRIPTION OF THE DRAWINGS

The aforementioned and other aspects, features and advantages can be more readily understood from the following detailed description with reference to the accompanying drawings wherein.

DETAILED DESCRIPTION OF THE INVENTION

Figure 1:
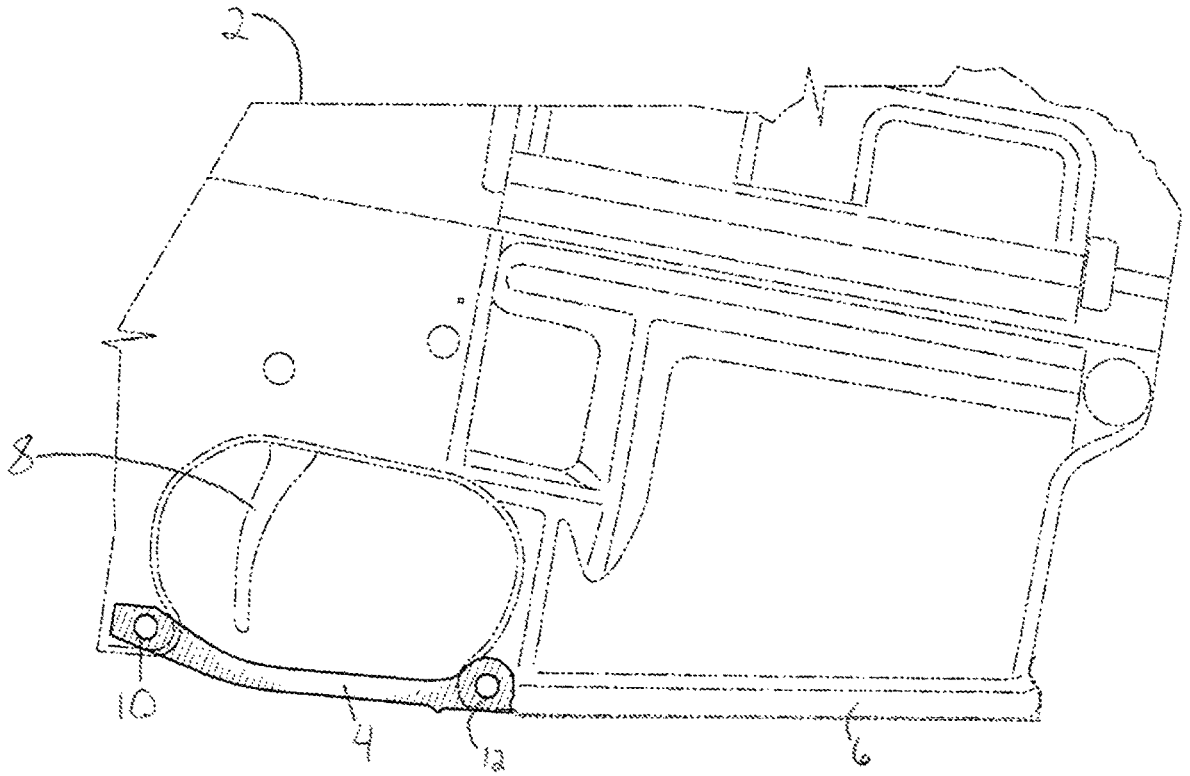
FIG. 1 (Prior Art)
FIG. 1 shows known prior art, which illustrates a side view of the right-side portion of the firearm having trigger guards.

FIG. 1 depicts a prior art trigger guard. FIG. 1 illustrates a side view of the right-side portion of a firearm (2) having a trigger guard (4), a trigger (8), and a magazine well (6). The trigger guard is (4) located to surround and protect the trigger (8). The trigger guard (4) is shown in a closed position. The trigger guard (4) shown in FIG. 1 is considered replaceable or removeable. The rear end of the trigger guard (4) is retained by a pin (10), while the front end is retained by an detent (12).

Figure 2:
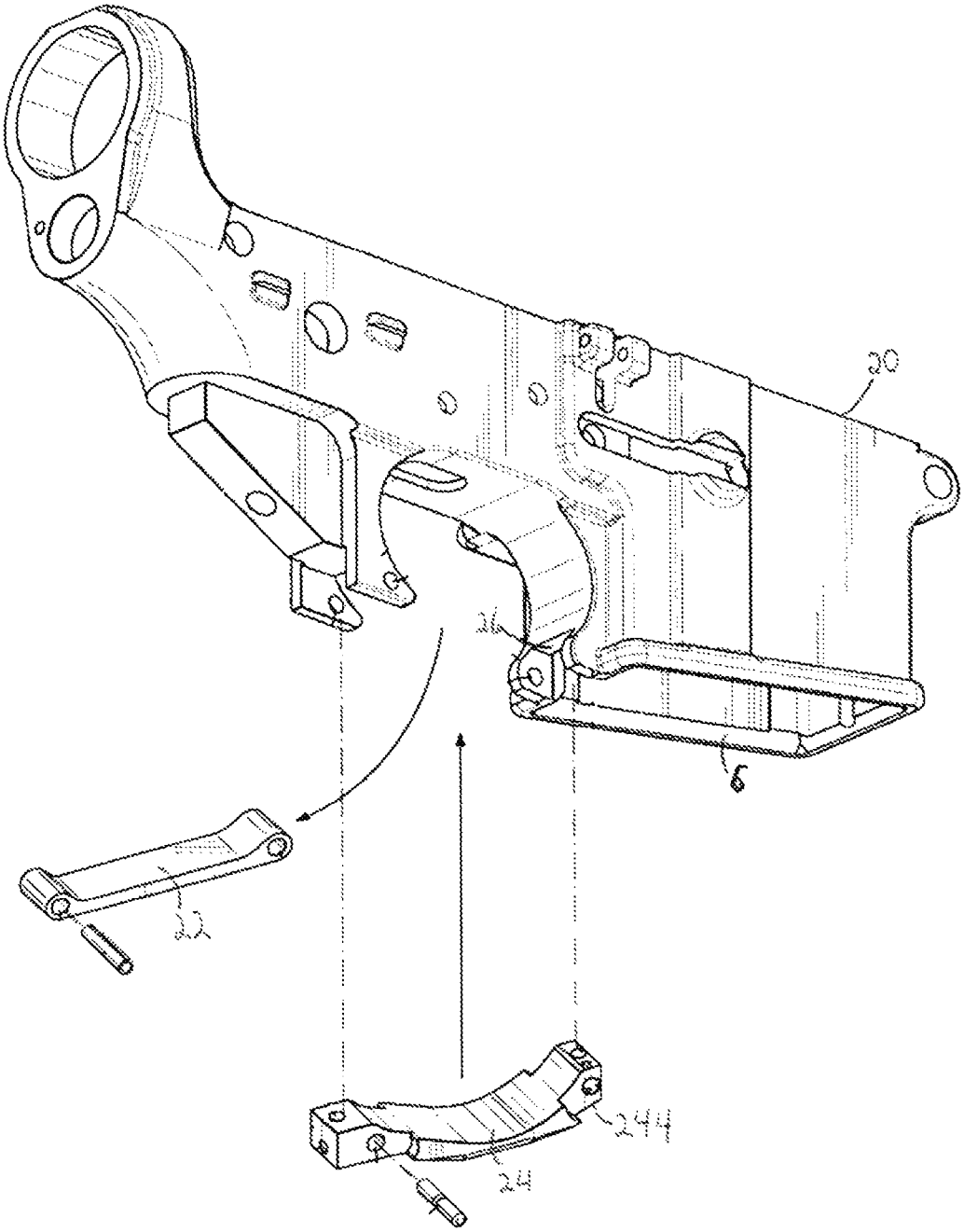
FIG. 2 (Prior Art)
FIG. 2 shows known prior art, which illustrates an exploded view of a receiver of a firearm having plural replaceable trigger guards.

FIG. 2 illustrates prior art of an exploded view of a receiver of a firearm (20) which can attach and detach plural trigger guards, such as a standard type trigger guard (22) and a design modified trigger guard (24). Both trigger guard (22) and trigger guard (24), respectively comprise a front side which faces towards a magazine well. When considering an example where the trigger guard (24) is attached to the receiver (20), a front portion (244) of the trigger guard (24) is positioned into a space (26) between a left and right side of the magazine well (6). As can be seen, the front side of each trigger guard is designed with a thin or short amount of material so to not come near, or make contact with a magazine to be loaded into the magazine well.

Figure 3:
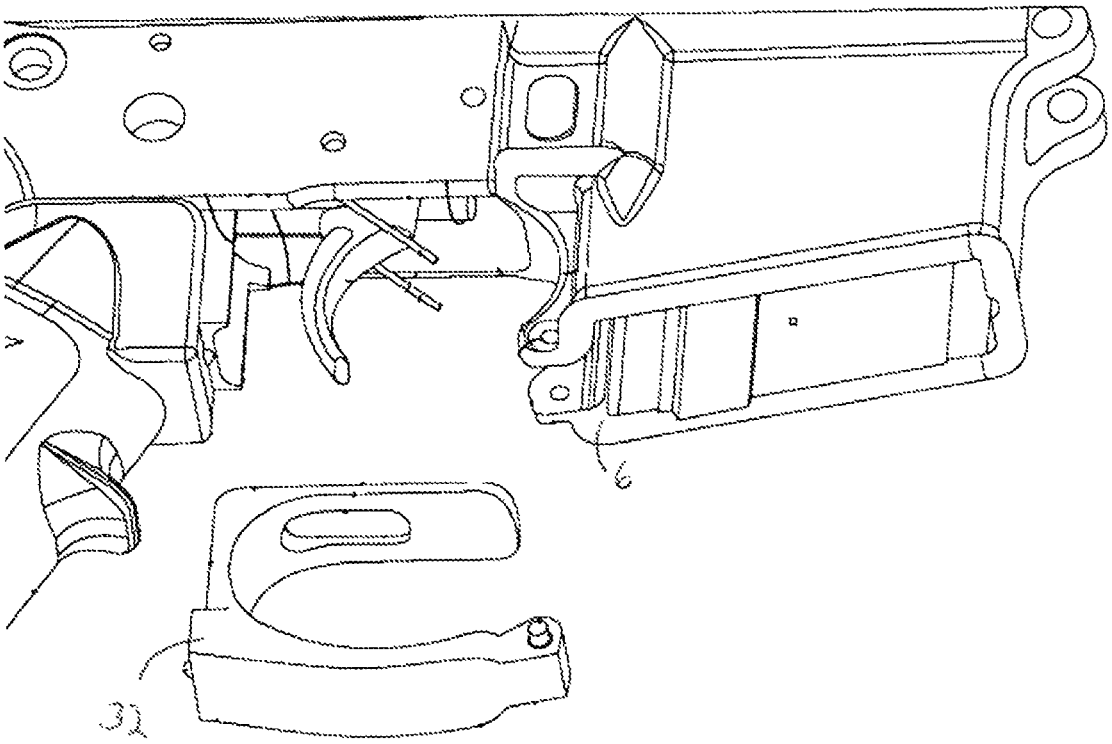
FIG. 3 (Prior Art)
FIG. 3 shows known prior art, which illustrates a perspective view of a firearm with an exploded removable trigger guard.

FIG. 3 illustrates prior art of a perspective view of a firearm with an exploded "C" shaped trigger guard.

Figure 4A:
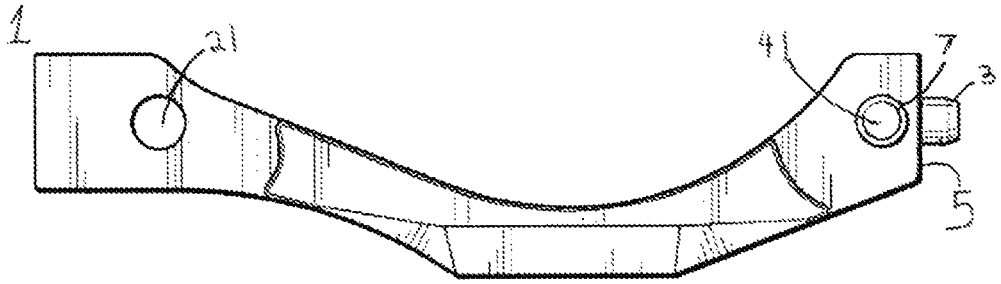
FIG. 4A illustrates a side elevated view of a trigger guard according to one embodiment of the present invention.
Figure 4B:
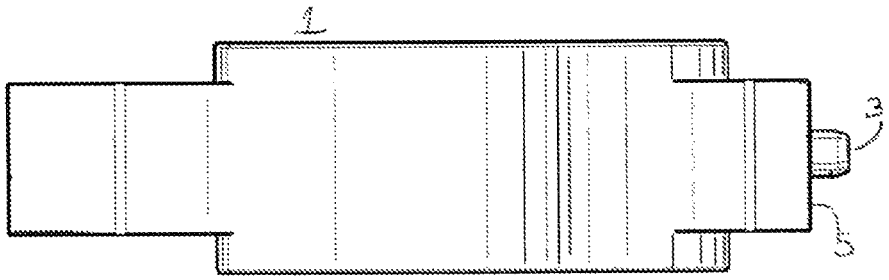
FIG. 4B illustrates a top plan view of the trigger guard.

Looking at FIGS. 4A and 4B, one embodiment of the present invention is shown. FIG. 4A illustrates side view of a trigger guard (1) according to one embodiment of the present invention. The trigger guard (1) as illustrated has a central portion with a design with a slight curved extension between the front side (5) and the rear side. Other designs of the central portion of the trigger guard are possible and may be used with the invention. The trigger guard (1) has a rear hole (21) and a front hole (41) that are used to attach and detach the trigger guard to a firearm. The front hole (41) is capable of receiving a pin (7) to accommodate the attachment step. The hole (21), (41), and pin (7) of FIG. 4A illustrations are of a circular and cylindrical shape, however any known setting shape can be used such as rectangular, polygonal, or the like. The projection (3) is capable of being produced from various metals, plastic, rubbers and any suitable materials of the like. Other techniques for attaching or detaching the trigger guard (1) are possible and may be used with the invention. The trigger guard (1) has a projection (3) extending form the front side (5). The trigger guard (1) is capable of being made from various metals, plastics, rubbers, and any other suitable materials.

FIG. 4B illustrates a top plan view of the trigger guard (1) of FIG. 4A.

In one aspect of the present invention, the projection (3) and the trigger guard (1) can be comprised as a single unit, such as using a molding to manufacturer the trigger guard (1). In another aspect of the invention, the projection may be considered an additive portion of the trigger guard to allow for adjustments as will be described in further detail below. An additional aspect could allow the projection (3) to slide onto the trigger guard (1) as an independent piece.

The trigger guard (1) of the present invention can be made in any desired functional or ornamental variation.

FIG. 5-8 depict variations of the trigger guard and projection.

Figure 5:
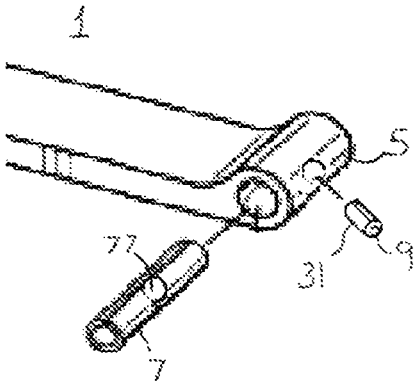
FIG. 5 illustrates an end view of a trigger guard according to one embodiment of the present invention.

FIG. 5 illustrates an end view of a trigger guard (1) according to one embodiment of the present invention. The projection (31) located on the front end of the trigger guard (1) shown in FIG. 5 comprises a ball bearing (9) on the end. The ball bearing (9), or any suitable device, may be moveable within the projection (31) or stationary. Further, as illustrated in FIG. 5, the projection (31) may be inserted into the hole (77) or the pin (7). In this instance, the projection and pin can be considered a single unit which is incorporated into the production of the trigger guard (1). Another alternative to the embodiment of FIG. 5 is to allow projection (31) and pin (7) to be inserted into the trigger guard (1), wherein the projection (31) may be screwed into or fastened to the pin (7) to allow adjustments of the extended length of the projection towards a magazine well or magazine. This is provided to accommodate the various designs in firearms and magazines of which the trigger guard (1) may be used with. Further, the adjustment of the projection (31) allows adjustment of the allowable movement of the magazine, amount of contact and/or pressure used against the magazine for purpose to be described below.

Figure 6:
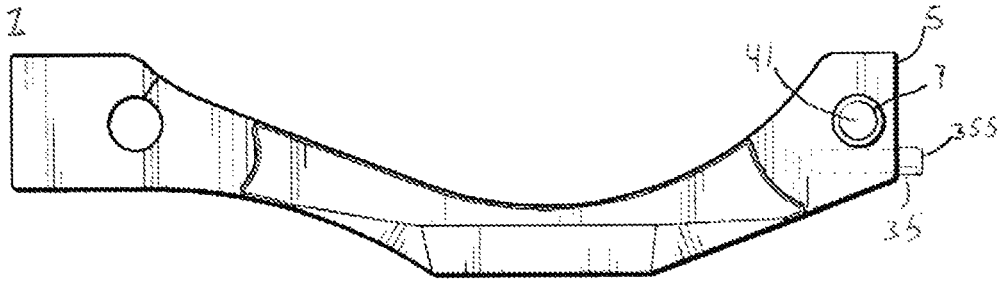
FIG. 6 illustrates a side elevated view of a trigger guard according to one embodiment of the present invention.

FIG. 6 illustrates a side view of a trigger guard (1) according to one embodiment of the present invention. The projection (35) located on the front end (5) of the trigger guard (1) is positioned so to not disturb the location of the pin (7) and hole (41). The projection (35) of FIG. 6 may be a formation of the trigger guard (1) itself and considered a single unit. In this instance, the projection (35) is capable of being adjusted by at least a portion (355) which could be cut, filed, or sanded to a desired length of extension. The projection (35) is capable of being an independent and separate part from the trigger guard (1), wherein the projection (35) is able to be attached to the trigger guard (1) by way of a tightening method, such as a screw design. This allows the projection (35) to be attached and provided an adjustment of the extension length, screwing in to shorten the length and unscrewing to increase the length. Though only a single portion (355) is illustrated, the portion (355) or the projection (35) may comprise plural portions to be used for adjustment.

Figure 7:
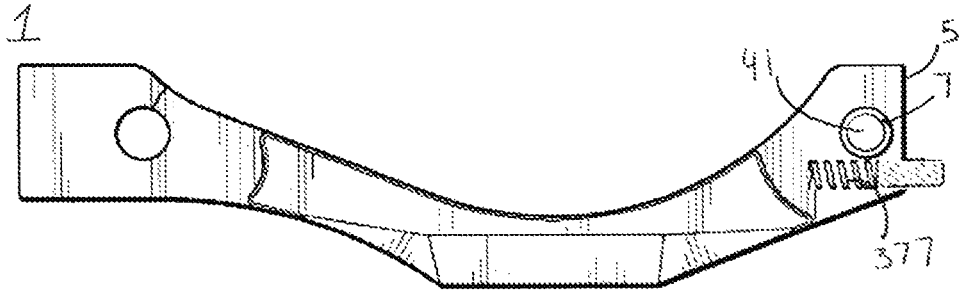
FIG. 7 illustrates a side elevated view of a trigger guard according to one embodiment of the present invention.

FIG. 7 illustrates a side view of a trigger guard (1) according to one embodiment of the present invention. Similar to that of FIG. 6 the projection (37) located on the front end (5) of the trigger guard (1) is positioned so not to disturb the location of the pin (7) and hole (41). The trigger guard (1) of FIG. 7 comprises a cavity comprising a spring like part or spring (377). The spring (377) and projection (37) may be physically connected as a single unit. Further, the projection (37) may position to allow the projection (37) to come in contact with the spring (377) upon applied force to the projection (37). For example, a magazine inserted into a firearm could apply a force upon the projection (37) when is use. An example of the spring (377) and projection (37) would comprise a spring-loaded ball bearing plunger system. The spring (377) can vary to allow various levels of force outward towards the front end (5) to be applied to the projection (37). Further, the length of the projection can be of varying lengths to accommodate desirable conditions.

Figure 8:
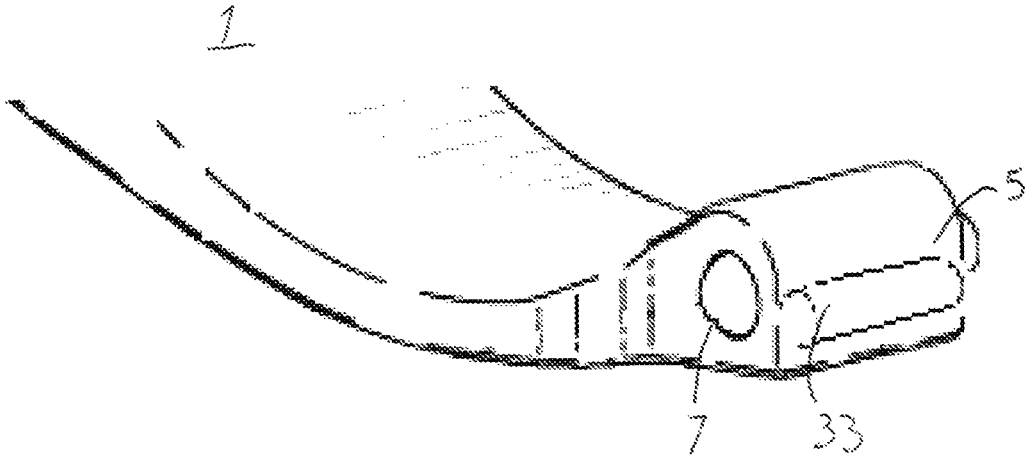
FIG. 8 illustrates an end view of a trigger guard according to one embodiment of the present invention.

FIG. 8 illustrates an end view of a trigger guard (1) according to one embodiment of the present invention. The projection (33) is attached and partially enclosed within the trigger guard (1). The projection (33) extends beyond the farthest point of the front end (5) in a direction towards a magazine or magazine well. The projection (33) of FIG. 8 is able to be rotated in an upward and downward motion to accommodate contact with the magazine, not illustrated, for loading and unloading purposes. The projection (33) can be partially enclosed within the front end (5) of the trigger guard (1) so to allow rotation of the projection while securely remaining attached to the trigger guard (1). Additionally, the projection (33) may be rotatable from a center rotation point, not illustrated, such as to allow rotation around a rod secured within the trigger guard (1). The projection (33) may also be rotatable from two center rotation points located on both ends, not illustrated, such as to allow rotation around two ball bearings or two pins located within the trigger guard (1).

Other techniques for providing a projection to extend form the front end (5) of the trigger guard (1) towards a magazine for use in a firearm are possible and may be used on the front end (5) of the trigger guard (1). Further, one or more projections may be used on the front end (5) of the trigger guard (1). Also, any combination of one or more projection types as indicated herein or as illustrated in FIG. 4A-8 may be used with the invention.

Figure 9:
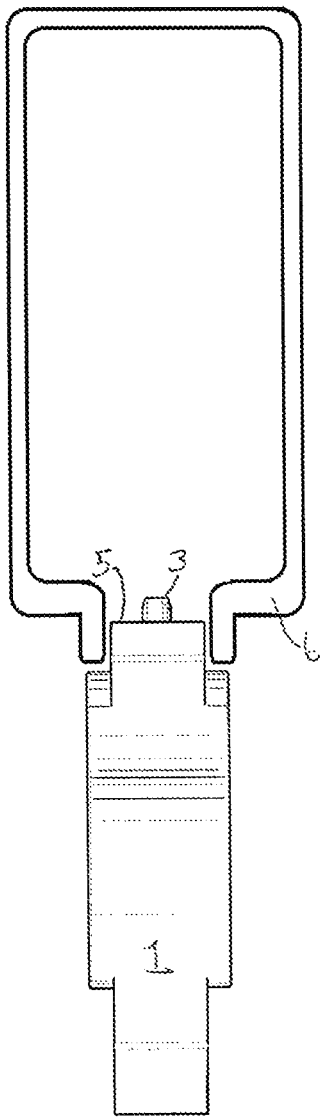
FIG. 9 illustrates a bottom view of a firearm having a magazine well and trigger guard according to one embodiment of the present invention.

FIG. 9 illustrates a bottom view of a firearm having magazine well (6) and trigger guard (1) according to one embodiment of the present invention. As can be seen in FIG. 9 the projection (3) extends from the trigger guard (1) into the magazine well (6). During operation of the firearm a magazine, not illustrated, would be inserted into the magazine well (6). The projection (3) is positioned to make physical contact with the magazine with the magazine or at least positioned to limit an amount of movement of the magazine within the magazine well (6). The projection (3) as described is capable of being adjusted to increase or shorten the length extended into the magazine well (6).

In an alternative embodiment, a magazine could be designed with a projection positioned such that the projection would extend on the rear face of the magazine to allow for contact on the front face of the trigger guard.

The present invention provides a solution to several common malfunctions when using firearms. Some of the most common malfunctions when using firearms are "jams"

or miss-feedings and the result of this is damage to the firearm. This invention aims to address at least common issues regarding magazine follower tilt and magazine movement which commonly cause firearm malfunctions. When considering general firearm design, magazine movement within a magazine well can generate a tilt forming a nose down bullet angle, where the front nose or front tip of the bullet is lower than the straight horizontal axis. A nose down bullet angle commonly results in malfunctions during firearm use. Whereas, nose up bullet angle aids in proper feeding of the bullet cartridge. Firearms are created such that a nose up bullet angle, where the front nose or front tip of the bullet is equal to or above a straight horizontal axis. This is preferred and needed for proper feeding of the firearm.

The present invention provides an advantage of solving these and similar problems. In one aspect of the present invention, a projection of the trigger guard is to provide limiting structure or pressure to the rear face of the magazine. This projection then results in the cartridges within the loaded magazine to have a needed nose up bullet angle. The projection of the trigger guard in the present invention is able to contact the back of the magazine pushing it forward. By using the trigger guard with the projection of the present invention, the projection extends beyond the front face of the trigger guard to apply enough pressure to the magazine inserted into the magazine well to establish a consistent force to properly align the magazine within the magazine well to maintain a nose up bullet angle during usage of the firearm without malfunctions.

While an exemplary embodiment of the present invention has been described in detail, it should be apparent that modifications and variations thereto are possible, all of which fall within the true spirit and scope of the invention. Therefore, the foregoing is considered as illustrative only of the principles of the invention and, since modifications and changes will be apparent to those skilled in the art. It is not intended to limit the invention to the exact construction and operations shown and described. Accordingly, all suitable modifications and equivalents may be resorted to, falling within the scope of the invention.

The invention claimed is:

1. A trigger guard configured to be installed below a trigger of a firearm, comprising:

a main body comprising a front end, the front end of the main body of the trigger guard faces towards a magazine well of a firearm when installed on the firearm;

a front hole and a rear hole for attachable installation of the trigger guard to a lower receiver of the firearm, wherein the entire trigger guard is installed and positioned below a trigger;

a projection positioned at the front end of the main body of the trigger guard, the projection protrudes at the front end of the main body of the trigger guard in a direction towards the magazine well;

wherein the trigger guard, the main body, the projection, the front hole and the rear hole are each positionally below the trigger when the trigger guard is installed on the firearm for use; and wherein the projection extends into the magazine well or a space within the magazine well and is configured to apply a force to a magazine inserted into the magazine well.

2. The trigger guard of claim 1, wherein the projection extending from the front end of the main body of the trigger guard is adjustable.

3. The trigger guard of claim 2, wherein the projection is adjusted so to increase or decrease a length extending from the front end of the main body of the trigger guard.

4. The trigger guard of claim 2, wherein the projection is adjusted so to increase or decrease an amount of force applied to an object in contact with the projection.

5. The trigger guard of claim 1, wherein the projection is attachable to the trigger guard.

6. The trigger guard of claim 1, wherein the projection comprises a ball bearing.

7. The trigger guard of claim 1, wherein the projection comprises an elongated rotatable or rolling member.

8. The trigger guard of claim 1, wherein the projection comprises a spring.

9. The trigger guard of claim 1, wherein the projection is screwed into or fastened to the trigger guard.

10. The trigger guard of claim 1, further comprising:

a pin, wherein the projection is connected to or attached to the pin.

11. The trigger guard of claim 2, wherein the projection is adjustable by means of a projection portion that is at least one of cut, filed or sanded to a desired amount of extension.

12. The trigger guard of claim 1, further comprising:

an internal cavity positioned within the front end of the main body of the trigger guard;

wherein the projection is encompassed within the internal cavity such that the projection protrudes at the front end of the main body of the trigger guard in a direction towards the magazine well.

13. A trigger guard configured to be installed on a firearm, the trigger guard comprising:

a main body comprising a front end, the front end of the main body of the trigger guard faces towards a magazine well of a firearm when installed on the firearm;

a projection positioned at the front end of the main body of the trigger guard, the projection protrudes at the front end of the main body of the trigger guard in a direction towards the magazine well;

wherein the projection extends into the magazine well or a space within the magazine well and is configured to apply a force to a magazine inserted into the magazine well; and wherein the projection comprises a ball bearing.

14. The trigger guard of claim 13, wherein the projection extending from the front end of the main body of the trigger guard is adjustable.

15. The trigger guard of claim 14, wherein the projection is adjusted so to increase or decrease a length extending from the front end of the main body of the trigger guard, or is adjusted so to increase or decrease an amount of force applied to an object in contact with the projection.

16. The trigger guard of claim 13, wherein the projection is attachable to the trigger guard.

17. The trigger guard of claim 13, wherein the projection comprises a spring.

18. The trigger guard of claim 13, wherein the projection is screwed into or fastened to the trigger guard.

19. The trigger guard of claim 13, further comprises:

a pin, wherein the projection is connected to or attached to the pin.

* * * * *